US006012463A

United States Patent [19]

Mitchell, Jr.

[11] Patent Number: 6,012,463

[45] Date of Patent: Jan. 11, 2000

[54] SHAVING METHOD AND SHAVING KIT

[76] Inventor: Clarence Mitchell, Jr., 3608 Fairmeade Dr., Nashville, Tenn. 37218

[21] Appl. No.: 09/206,260

[22] Filed: Nov. 24, 1998

[51] Int. Cl.[7] ..... A45D 24/00

[52] U.S. Cl. ..... 132/200; 132/286; 132/289; 206/228; 30/40.2

[58] Field of Search ..... 132/286, 289, 132/290, 200, 292; 206/581, 228, 234, 235, 38, 373; 30/40.2, 541; 510/389, 129, 133, 505

[56] References Cited

U.S. PATENT DOCUMENTS

| | | | |
|---|---|---|---|
| 998,576 | 7/1911 | Hawkins | 132/289 |
| 1,346,541 | 7/1920 | Harding | 132/290 |
| 1,515,542 | 11/1924 | Bouquet | 132/290 |
| 1,612,491 | 12/1926 | Crookston | 132/289 |
| 1,758,338 | 5/1930 | Simos | 206/228 |
| 2,769,565 | 11/1956 | Sottile | 132/289 |
| 3,846,326 | 11/1974 | Wright et al. | 510/389 |
| 4,327,961 | 5/1982 | Kladitis | 132/290 |
| 4,339,876 | 7/1982 | Davis | 30/541 |
| 4,709,481 | 12/1987 | Moore . | |
| 4,819,669 | 4/1989 | Politzer | 132/200 |
| 4,944,939 | 7/1990 | Moore . | |
| 4,979,525 | 12/1990 | Chiou | 132/286 |
| 5,152,064 | 10/1992 | Johnston | 30/45 |
| 5,387,412 | 2/1995 | Moore . | |
| 5,626,154 | 5/1997 | Rogers et al. | 132/200 |

*Primary Examiner*—Gene Mancene
*Assistant Examiner*—Pedro Philogene
*Attorney, Agent, or Firm*—Lucian Wayne Beavers Waddey & Patterson

[57] ABSTRACT

This invention relates to a method for reducing folliculitis. A method is disclosed which delineates precise razor pulling techniques and methods of preparing a skin surface to be shaved. The razor pulling methods comprise consistent razor strokes. A kit comprising tools for carrying the disclosed method is also disclosed.

19 Claims, 4 Drawing Sheets

SHAVING METHOD AND SHAVING KIT

BACKGROUND OF THE INVENTION

Many with sensitive skin particularly in the African American community have suffered from folliculitis throughout the years. Folliculitis is inflammation of one or more follicles, especially of the hair. Ingrown hairs or hair bumps are the cause of folliculitis. It is generally thought that it is also caused by improper shaving techniques. It can be very painful and unsightly. What is needed is a method for reducing folliculitis. This method should be effective and relatively simple.

SUMMARY OF THE INVENTION

This invention relates to a method for reducing folliculitis. The method delineates precise razor pulling techniques and methods of preparing the skin surface to be shaved. The razor pulling methods comprise consistent razor strokes. The consistent razor strokes train the hair to grow in a uniform pattern. It is important and necessary to avoid shaving hair below the surface of the skin. The preparation phase is important for reducing the infected areas and for allowing the hair to grow from beneath the surface of the skin.

Accordingly an object of the present invention is to provide a method of reducing folliculitis.

Another object of the invention is to reduce unsightful skin problems.

Another object of the invention is to provide the tools for reducing folliculitis in a convenient location.

Another object of the present invention is to provide a method of improved shaving.

Another object of the present invention is to provide a method of reducing infected skin areas due to improper shaving techniques.

Other objects and advantages of the invention will be apparent to those skilled in the art from the teachings provided in the detailed portion of this present invention.

DESCRIPTION OF THE PREFERRED EMBODIMENTS

Figure 1:
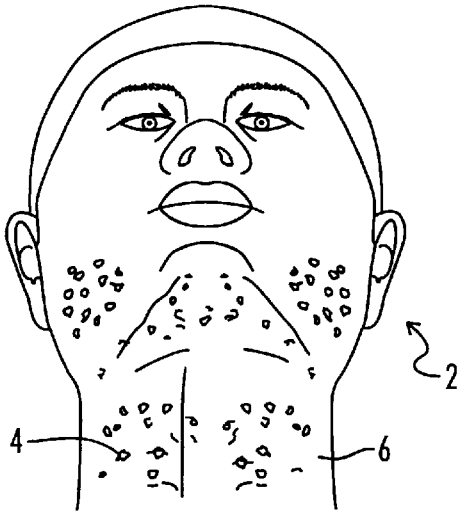
FIG. 1 shows neck and chin areas of an individual suffering from folliculitis.

The present invention relates to a method of reducing folliculitis. More particularly the present invention relates to a method of shaving for reducing folliculitis. The present invention also relates to a kit comprising components necessary for carrying out methods of the present invention.

The present invention will be most clearly understood by reference to the attached drawings wherein like reference numerals and characters refer to like parts.

Figure 2:
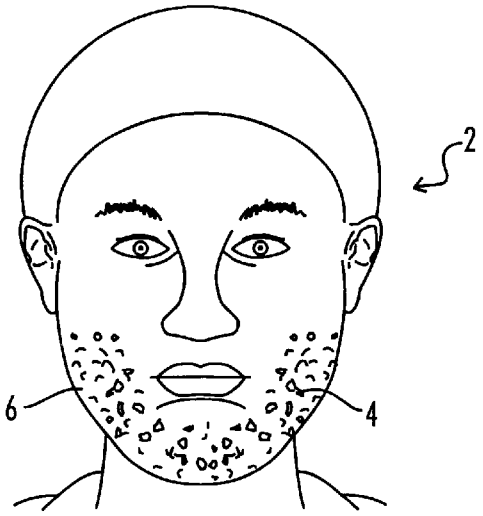
FIG. 2 shows face and chin areas of an individual suffering from folliculitis.

Folliculitis is generally the inflammation of one or more follicules, especially of the hair. Folliculitis can be a very painful and unsightly skin problem. It is generally caused by ingrown hairs or hair bumps caused by improper shaving techniques. FIGS. 1 and 2 show an individual 2 with affected areas 4. Typically the affected areas 4 become infected. Men with sensitive skin particularly in the African American community, have suffered with this problem throughout the years.

Figure 6:
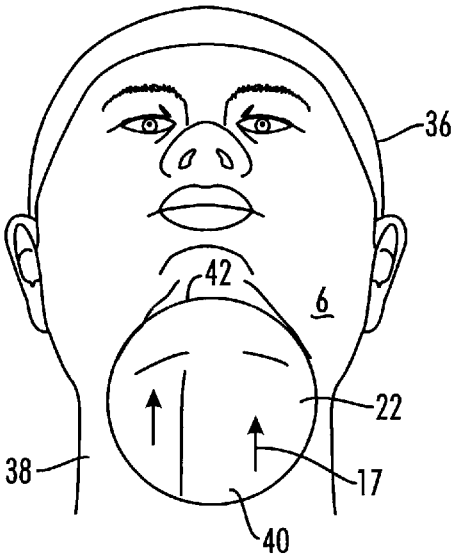
FIG. 6 shows a method of tightening skin on the neck and a preferred direction of shaving the neck.
Figure 7:
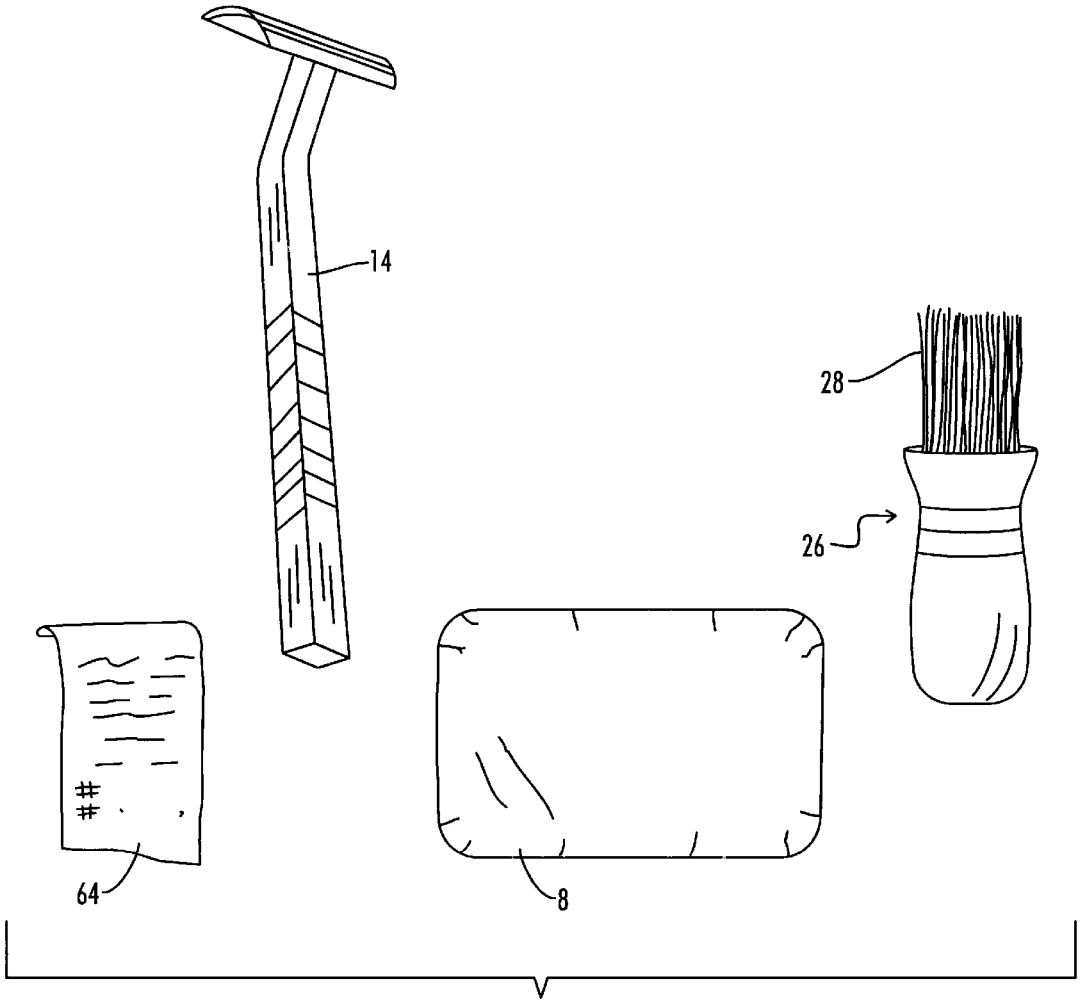
FIG. 7 shows preferred components for carrying out a method of reducing folliculitis.

The present invention includes a method of reducing folliculitis comprising the steps of preparing a skin surface 6 to be shaved, for at least two days prior to shaving including scrubbing the skin surface with a non-oil-based cleanser 8. Preferably, preparation should be for at least four days prior to shaving. The skin surface to be scrubbed is shown in FIGS. 1, 2, 3, and 6. The non-oil-based cleanser 8 shown in FIG. 7 is preferably an anti-bacterial soap.

A method of the invention further comprises shaving the skin surface 6 after the two days of preparation, including shaving a plurality of hairs 10 above a skin line 12 located at the skin surface 6. Preferably, the skin is prepared for four days prior to shaving. See FIG. 3. The method further includes pulling a razor 14 in a plurality of consistent uni-directional motions 16 to carry out the step of shaving. The razor is shown in FIG. 7 and representative uni-directional motions 16 are shown in FIGS. 4*a* and 4*b*. It is important that the direction of the motions be in one direction and they be consistent, not in a multitude of directions.

One embodiment of the present invention includes a preparing step comprising preparing the surface 6 to be shaved twice a day for four days prior to shaving the skin surface 6. Another embodiment of the present invention includes scrubbing with a non-oil-based cleanser 8 which is preferably an anti-bacterial soap comprising triclosan as an active ingredient. An anti-bacterial soap comprising triclosan is currently sold under the trademarks of Clearasil®, Stridex®, and Oxy®.

Figure 3:
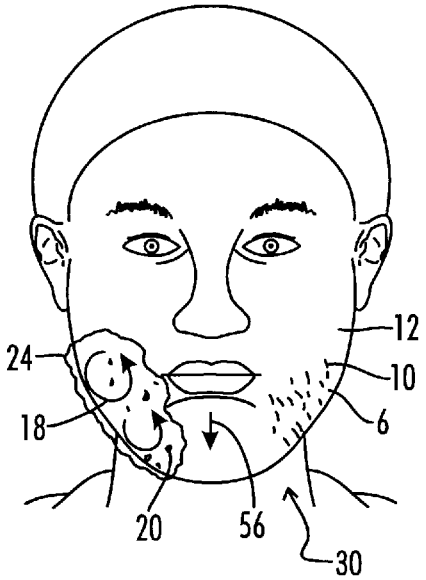
FIG. 3 shows an infected area being scrubbed with lather from a non-oil-based cleanser.
Figure 4A:
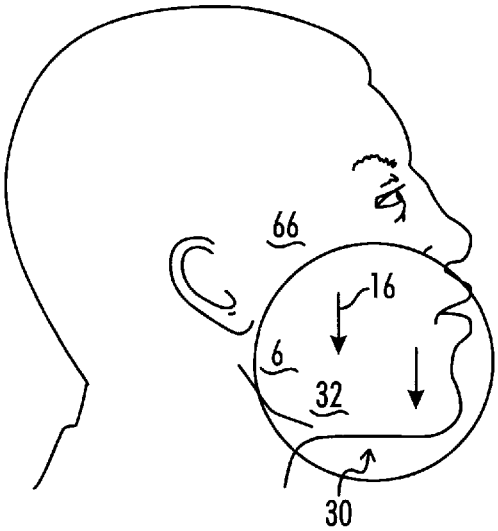
FIG. 4*a* shows uni-directional razor strokes being applied to a first side of a face.
Figure 4B:
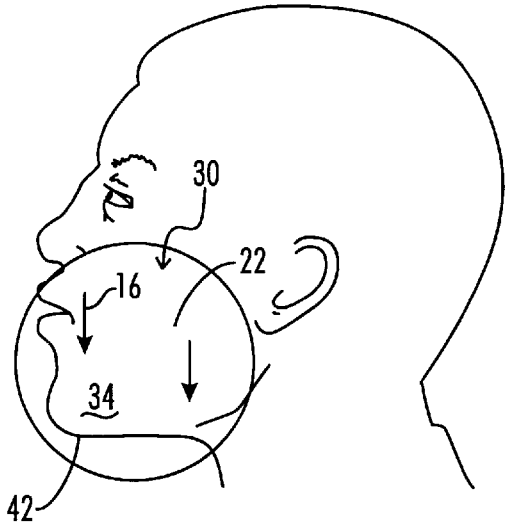
FIG. 4*b* shows uni-directional razor strokes being applied to a second side of a face.

In one embodiment of the invention, the step of scrubbing comprises scrubbing in a circular motion 18, see FIG. 3, for at least two minutes. This, preferably, includes scrubbing a plurality of infected areas 20 of the skin surface 6 to be shaved.

Preferably the step of preparing the skin surface 6 comprises avoiding the use of oil-based and lanolin based products on the skin surface 6 to be shaved. Such products are typically found in conventional shaving foams or shaving creams. Mostly it is preferred that individual 2 use an anti-bacterial soap, preferably comprising triclosan, while scrubbing.

One embodiment of the present invention includes the step of shaving comprising drawing the skin surface 6 tight to create a smooth surface 22 to which the razor 14 is to be applied. FIG. 6 shows the skin surface 6 being pulled tight to achieve a smooth surface 22 to be shaved. Other conventional methods for tightening the skin surface 6 to be shaved includes drawing the skin with one's fingers as one tilts the head and neck in appropriate directions. Another embodiment of the invention includes pressing lightly enough with the razor 14 to avoid creating an indentation in the skin surface 6.

Another embodiment of the present invention includes the step of shaving comprising applying a lather 24, shown in FIG. 3, with a barber brush 26, shown in FIG. 7. In a preferred embodiment a barber's brush 26 comprises boar's hair bristles 28. The lather is preferably formed from an anti-bacterial soap containing triclosan.

Another embodiment of the invention comprises pulling the razor 14 downwardly in a plurality of single strokes 16 on a face 30. The downward arrows 16 indicate the shaving strokes and direction of the shaving strokes. The strokes 16 are shown in FIGS. 4*a* and 4*b*. In a preferred embodiment the face 30 includes a first side 32 and a second side 34 to which a plurality of single strokes 16 are applied.

Another embodiment of the present invention comprises tilting a head 36 back to tighten a portion of the skin 22 on a neck 38. See FIG. 6. The method may further include pulling the razor 14 gently upward from a low point 40 on the neck 38 to a point 42 where the downward razor strokes ended. The upward razor strokes are indicated by arrows 17 in FIG. 6.

Figure 9:
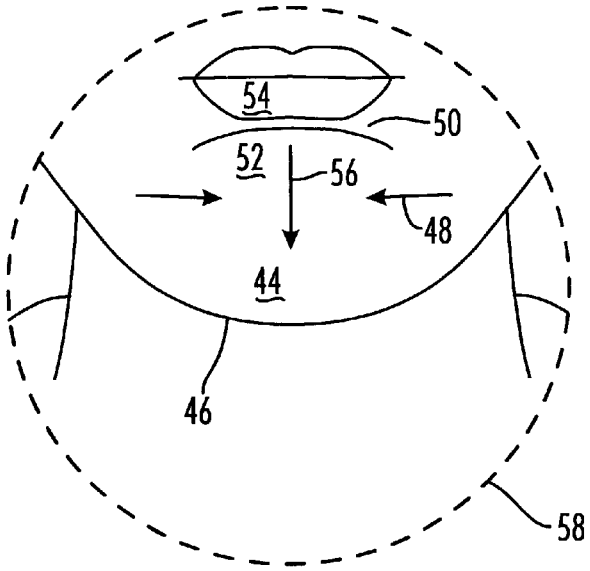
FIG. 9 shows a blow-up of the chin area shown in FIG. 5.

One embodiment of the invention includes pulling the razor 14 from one of the sides 32 or 34 of the face 30 toward a center point 44 of a chin 46. See FIG. 5 in which direction arrows 48 indicate the direction of the razor stroke toward the center 44 of the chin 46. Preferably this is done while placing a tongue (not shown) in a gum line 50 to tighten a portion of skin 52 below a bottom lip 54. See FIGS. 5 and 9.

Figure 5:
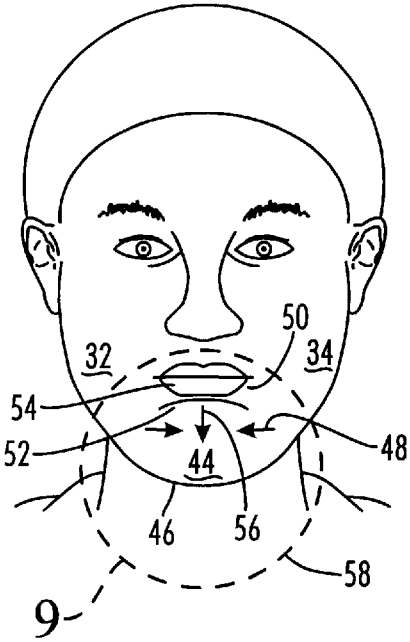
FIG. 5 shows shaving stroke directions around a chin area.

Another embodiment of the invention further includes pulling the razor 14 downward from the lower lip, or bottom lip, 54 toward the chin 46 while placing the tongue (not shown) in the gum line 50. FIG. 5 shows direction arrow 56 for the razor stroke being pulled from the gum line 50 toward the chin 46. Circle 58 shown in FIG. 5 is blown up in FIG. 9 to more clearly show the details of the shaving technique around the area of the chin 46.

Another method of the present invention includes reducing ingrown hairs comprising the steps of preparing a skin surface 6 to be shaved for four days prior to shaving by scrubbing the skin surface 6 twice a day with an anti-bacterial soap 8 for at least two minutes and avoiding application of any oil-based products to the skin surface 6 during the preparing step. The method also includes shaving the skin surface 6 on a fifth day with a plurality of uni-directional motions 16 without shaving a plurality of hairs 10 below the skin surface 6.

Figure 8:
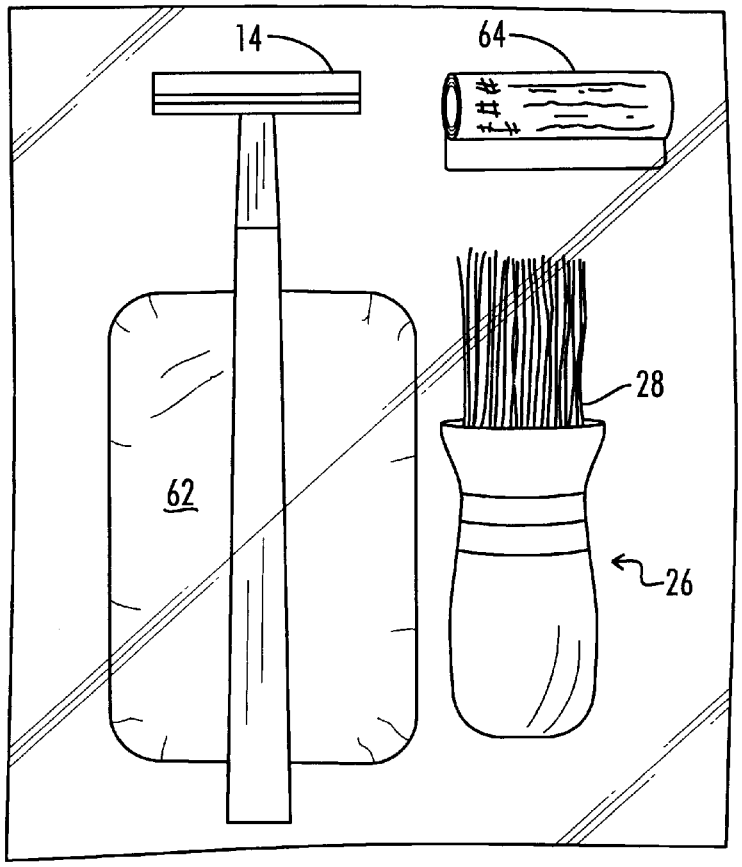
FIG. 8 shows a kit comprising tools for carrying out a method of reducing folliculitis.

Another embodiment of the present invention includes a kit 60 shown in FIG. 8. The kit 60 includes a razor 14 and an anti-bacterial soap 62. Preferably the kit 60 includes instructions 64 setting forth a process for reducing folliculitis. In a preferred embodiment the kit 60 further comprises a barber's brush 26. In a preferred embodiment the barber's brush 26 comprises boar's hair 28. FIG. 7 shows elements of a kit for use in methods of the present invention. The cleanser 8 shown in FIG. 7 is a non-oil-based cleanser without lanolin. However the soap 62 shown in FIG. 8 is an anti-bacterial soap.

It is important not to use any oil or oil-based products on the face during the preparation stage. Alcohol-based aftershaves, however, would be preferable during this phase. The preparation should be done twice a day, preferably, during the morning and during the evening.

Preferably on the fifth day of the process of the present invention one shaves with the razor 14 for the first time. Using the barber's brush 26 one should work up a good lather 24 in a soap cup and apply it to the infected area 20 of the face 30 to be shaved in a circular motion 18. See FIG. 3. One can begin shaving on either the right or left side of the face 30. It is important to keep in mind the importance of razor pulling technique.

Preferably starting at the sideburn 66, shown in FIG. 4*a*, pull the razor 14 allowing it to cut rather than you to cut by your efforts. It is important not to push the razor 14 into the skin 6. One should not press so hard as to create an indentation in the skin surface. If this happens, the razor 14 will cut through a first layer of skin, thus damaging the hair follicles. The hairs 10 on the face 30 should only be shaved even with the surface of the skin 6. Pressing too hard so as to create an indentation will result in shaving hair 10 below the skin line 12. In addition, one should always pull the razor in one direction. This is shown in FIG. 4*a* and FIG. 3.

If one misses a spot to be shaved, one should not shave upwards. One should simply reapply lather 20 to the missed area and shave downward, as previously discussed. It is important to remember that when shaving either portion of the face 30, the skin 6 should be drawn tight to create a smooth flat surface 22.

When shaving the neck area 38, tilt the head 6 backward to tighten the skin 6. Begin as low on the neck as is comfortable, then use a precise razor pulling technique and gently drag the razor 14 upward to the point 42 where downward shaving was stopped on both the right and left sides 32 and 34 of the face 30.

Shaving the portion of skin 52 below the bottom lip 54 is more complicated. In one preferred embodiment one should place the tongue along the lower gum line 50 to tighten the skin 52 in that area. One of two preferred ways of shaving this area will be described. The first uses a horizontal motion 48 gently drag the razor 14 from either the right or left side 32 or 34 of the mouth to the opposite side. Do not drag the razor 14 back and forth over the chin 46. Rather use single strokes 48 from the corner of the mouth from which shaving was begun. See FIG. 9. Continue this process until all hairs 10 are removed from this area of the face 30. The second uses a vertical motion 56 gently drag the razor 14 in a downward motion from either the right or left corner of the mouth to the opposite direction. Do not drag the razor up and down over the chin.

Once shaving is complete, one should rinse face 30 with warm water and pat skin dry with a towel. An aftershave can be used, however, keep in mind that it should be alcohol based. Continue to avoid using oil or oil-based lotions.

The consistency of the shaving pattern trains the hair to grow in specific directions. It is this consistency of shaving which reduces or stops the spread of folliculitis. Thus, although there have been described particular embodiments of the present invention of a new and useful Shaving Method And Shaving Kit, it is not intended that such references be construed as limitations upon the scope of this invention except as set forth in the following claims.

What is claimed is:

1. A method of reducing folliculitis comprising the steps of:

preparing a skin surface to be shaved for at least two days prior to shaving including scrubbing the skin surface with a non-oil-based cleanser;

shaving the skin surface after two days of preparation, including shaving only a plurality of hairs above a skin line located at the skin surface; and pulling a razor in a plurality of consistent uni-directional motions to carry out the step of shaving.

2. The method of claim 1, wherein the preparing step comprises preparing the surface to be shaved twice a day for four days prior to shaving the skin surface.

3. The method of claim 1, wherein the step of scrubbing with a non-oil-based cleanser comprises scrubbing with an anti-bacterial soap.

4. The method of claim 3, wherein the step of scrubbing with an anti-bacterial soap comprises providing anti-bacterial soap having an active ingredient including triclosan.

5. The method of claim 3, wherein the step of scrubbing with an anti-bacterial soap comprises scrubbing in a circular motion for at least two minutes, including scrubbing a plurality of infected areas of the skin surface to be shaved.

6. The method of claim 1, wherein the step of preparing the skin surface comprises avoiding use of oil, oil-based, and lanolin products on the skin surface to be shaved.

7. The method of claim 1, wherein the step of shaving comprises the steps of:

drawing the skin surface tight to create a smooth surface to which the razor is to be applied; and pressing lightly enough with the razor to avoid creating an indention in the skin surface.

8. The method of claim 1, wherein the step of shaving comprises applying a lather with a barber brush.

9. The method of claim 8, wherein the step of applying a lather comprises applying a lather from an anti-bacterial soap in a circular motion with a barber's brush including boar's hair.

10. The method of claim 1, wherein the step of pulling the razor comprises pulling the razor downward in a plurality of single strokes on both sides of a face.

11. The method of claim 10, wherein the step of pulling the razor further comprises the steps of:

tilting a head back to tighten a portion of skin at a neck; and pulling the razor gently upward from a low point on the neck to a point where pulling the razor downward was stopped.

12. The method of claim 10, wherein the step of pulling the razor further comprises:

pulling the razor from one of the sides of the face toward a center of a chin while placing a tongue in a gum line to tighten a portion of skin below a bottom lip; and pulling the razor from another of the sides of the face toward the center of the chin while placing the tongue in the gum line.

13. The method of claim 12, wherein the step of pulling the razor further comprises pulling the razor downward from the lower lip toward the chin while placing the tongue in the gum line.

14. A method of reducing ingrown hairs comprising the steps of:

preparing a skin surface to be shaved for four days prior to shaving by scrubbing the skin surface twice-a-day with an anti-bacterial soap for at least two minutes;

avoiding application of any oil-based products to the skin surface during the preparing step; and shaving the skin surface on a fifth day with a plurality of uni-directional motions without shaving a plurality of hairs below the skin surface.

15. A kit for reducing folliculitis comprising:

a razor;

an anti-bacterial soap; and a set of instructions delineating a process for reducing folliculitis.

16. The kit of claim 15, further comprising a barber's brush.

17. The kit of claim 16, wherein the barber's brush comprises boar's hair.

18. The kit of claim 15, wherein the anti-bacterial soap has an active ingredient including triclosan.

19. The kit of claim 15, further comprising:

a boar's hair barber's brush; and wherein the anti-bacterial soap has an active ingredient including triclosan.

* * * * *